United States Patent [19]

Wright

[11] Patent Number: 4,923,376

[45] Date of Patent: May 8, 1990

[54] MOINEAU PUMP WITH ROTATING CLOSED END OUTER MEMBER AND NONROTATING HOLLOW INNER MEMBER

[76] Inventor: John L. Wright, 1021 Salamanca Rd. NW., Albuquerque, N. Mex. 87107

[21] Appl. No.: 173,741

[22] Filed: Mar. 24, 1988

[51] Int. Cl.[5] ..... F04C 2/102; F04C 5/00

[52] U.S. Cl. ..... 418/48; 418/153; 418/161; 418/183

[58] Field of Search ..... 418/48, 183, 160, 161, 418/153

[56] References Cited

U.S. PATENT DOCUMENTS

| | | | |
|---|---|---|---|
| Re. 29,180 | 4/1977 | Clark | 418/48 |
| 1,892,217 | 12/1932 | Moineau | 418/48 |
| 2,028,407 | 1/1936 | Moineau | 418/48 |
| 2,505,136 | 4/1950 | Moineau | 418/48 |
| 2,525,265 | 10/1950 | Moineau | 418/48 |
| 2,527,670 | 10/1950 | Allen | 418/48 |
| 2,532,145 | 11/1950 | Byram | 418/48 |
| 2,545,626 | 3/1951 | Moineau | 418/48 |
| 2,612,845 | 10/1952 | Byram et al. | 418/48 |
| 2,915,979 | 12/1959 | Bourke et al. | 418/48 |
| 3,165,065 | 1/1965 | Stickel | 418/48 |
| 3,203,350 | 8/1965 | Chang | 418/48 |
| 3,512,904 | 5/1970 | Allen | 418/48 |
| 3,567,348 | 3/1971 | Benson | 418/48 |
| 3,746,310 | 7/1973 | Fransson et al. | 418/48 |
| 3,930,765 | 1/1976 | Watte | 418/48 |
| 3,938,744 | 2/1976 | Allen | 418/48 X |
| 4,080,115 | 3/1978 | Sims et al. | 418/48 |
| 4,140,444 | 2/1979 | Allen | 418/48 |
| 4,153,397 | 5/1979 | Allen | 418/48 |
| 4,237,704 | 12/1980 | Varadan | 418/48 |
| 4,325,682 | 4/1982 | Willis | 418/48 |
| 4,591,322 | 5/1986 | Ono et al. | 418/48 |
| 4,599,056 | 7/1986 | Crase | 418/48 |
| 4,614,232 | 9/1986 | Jurgens et al. | 166/105.5 |
| 4,639,200 | 1/1987 | Baumgardner et al. | 418/48 |

FOREIGN PATENT DOCUMENTS

| | | | |
|---|---|---|---|
| 972796 | 10/1964 | United Kingdom | 418/48 |
| 2120731 | 12/1983 | United Kingdom | 418/48 |

*Primary Examiner*—John J. Vrablik

*Attorney, Agent, or Firm*—Karla Ojanen; Kenneth E. Darnell

[57] ABSTRACT

An arrangement for an improved Moineau pump, i.e., a progressing cavity pump with a helical gear pair, wherein the closed end outer gear rotates and orbits relative to a nonrotating hollow inner gear. A hollow inner gear comprising an internal chamber extending axially allows the flow of pumpable material from progressing cavities to the closed end and through the hollow inner gear. The integral and smooth construction of the outer gear and the closed end eliminate contamination sites and further eliminate the need for seals or flexing components which contact the pumpable material. The hollow inner gear can be manufactured to integrally connect to a discharge conduit. The improved pump presented herein can be used within a material containment vessel, and the invention can be positioned to avoid contact of the pumpable material with any rotating couplings. An alternative embodiment presents a closed end outer gear with an internal chamber for use of a pressurized fluid distinct from the pumpable material. Means for connecting the improved Moineau pump to pump body is further provided. An orbital assembly allowing for orbit of the closed end outer gear about the hollow inner gear, but restricting the orbital and axial motion of the inner gear is also disclosed.

11 Claims, 10 Drawing Sheets

MOINEAU PUMP WITH ROTATING CLOSED END OUTER MEMBER AND NONROTATING HOLLOW INNER MEMBER

TECHNICAL FIELD

This invention relates to a progressing cavity pump of the helical gear pair type, i.e., Moineau. This type of pump is widely used in many industries including food processing, waste treatment, cementitious construction, chemical processing and others.

BACKGROUND OF THE INVENTION

Progressing cavity pumps made from helical gear pairs have been known since their invention disclosed in U.S. Pat. No. 1,892,217, entitled "GEAR MECHANISM" to Moineau. These pumps are comprised of two helical gears, one inside the other. The gears are engaged with each other along a sealing line to create cavities which progress axially as one of the gear pair is rotated relative to the other. According to Moineau's teaching, the outer gear has one more helical thread than the inner gear. Helical gear pair progressing cavity pumps in which the inner gear has one more thread than the outer gear are taught in U.S. Pat. No. 3,512,904, entitled "PROGRESSING CAVITY HELICAL PUMP" to Allen. Either gear design will hereinafter be referred to as a Moineau pump. The gear pair of a Moineau pump is subject to extensive wear because of the sliding contact required to create progressing cavities between the gear pair. This frictional contact causes wear which necessitates frequent replacement of one or both gears. Commercially available Moineau pumps, as well as those disclosed in the prior art, require extensive disassembly of the pumping apparatus to replace the worn gear pair.

In addition to the gear pair, Moineau pumps require other moving parts because of relative gear movement. As one of the gear pair is rotated relative to the other, the centerline of one gear is also required to orbit or gyrate relative to the centerline of the other gear because of the basic geometry of the gear pair. This combination of movements is accommodated in the prior art by three basic approaches, but each approach requires that moving components other than the gear pair come in contact with the pumpable material. This contact is undesirable not only because of maintenance costs, but, in many instances, the pumpable material is corrosive, abrasive, explosive or otherwise incompatible with long term safe use of the pump in its intended application. Inspection and maintenance of these mechanical components as well as inspection, maintenance and replacement of the helical gear pair is a major cost of operating this type of pump.

One method to accommodate the movement of the gears relative to each other revealed in the prior art is to fix the outer gear of the pair and rotate the inner gear with a drive shaft. Thus, the inner gear orbits or wobbles while rotating. Various types of universal joints, flexible shafts and mechanical connections employing this first approach are disclosed in U.S. Pat. No. 2,028,407, entitled "GEAR MECHANISM," to Moineau; U.S. Pat. No. 3,567,340, entitled "SCREW PUMP PROVIDED WITH A RADIALLY MOVABLE ROTOR COUPLING," to Benson; U.S. Pat. No. 4,599,056, entitled "UNIVERSAL JOINT AND PROGRESSIVE CAVITY TRANSDUCER USING THE SAME," to Crase; U.S. Pat. No. 4,153,397, entitled "ROTOR DRIVE COUPLING FOR PROGRESSING CAVITY PUMP," to Allen; U.S. Pat. No. 4,140,444, entitled "FLEXIBLE SHAFT ASSEMBLY FOR PROGRESSING CAVITY PUMP," to Allen; U.S. Pat. No. 4,080,115, entitled "PROGRESSIVE CAVITY DRIVE TRAIN," to Sims et al.; U.S. Pat. No. 4,237,704, entitled "OLDHAM TYPE COUPLING AND PUMP EMBODYING THE SAME," to Varadan; and U.S. Pat. No. 4,591,322, entitled "ECCENTRIC ARCHIMEDIAN SCREW PUMP OF ROTARY DISPLACEMENT TYPE," to Ono et al.

Teachings of these patents and other means known in the prior art for permitting the rotary driven Moineau gear to freely align itself engagingly with the other gear of the Moineau pair will be referred to herein as a flexible rotary drive coupling.

A second arrangement revealed in the prior art to provide for the relative motion of the Moineau gear pair is to rotate one gear of the pair about a fixed axis and mount the nonrotating gear in a manner to permit it to wobble, orbit or gyrate relative to the rotating gear. Four different disclosures are taught in U.S. Pat. No. 2,505,136, entitled "INTERNAL HELICAL GEAR PUMP," to Moineau; U.S. Pat. No. 2,527,670, entitled "HELICAL PUMP," to Allen; U.S. Pat. No. 2,612,845, entitled "HELICAL GEAR PUMP WITH NONRIGID CASING," to Byram et al.; and U.S. Pat. No. Re. 29,180, entitled "MOINEAU PUMP WITH ROTATING OUTER MEMBER," to Clark. Clark teaches a method of securing the inner gear to prevent it from rotating while permitting it to wobble as the outer gear is rotated about its own axis. The embodiment of this disclosure, however, does not have sufficient resistance to axial thrust forces imparted to the inner gear during operation to provide reliable operation. The Clark invention also requires multiple bearings and rotating seals which are contacted by the pumpable material. Bvram's disclosure teaches a one piece elastomeric outer gear that is flexible in its retention structure so that it will wobble relative to the inner gear even though attached to a non-wobbling mount. This type of outer gear is normally used as a stator and is referred to in the prior art as a wobble stator.

The third approach to accommodate the relative motion of the Moineau gear pair is to rotate the inner gear of the pair through one flexible joint and mount the outer gear flexibly so that the wobbling or orbiting is shared by both gears. This approach is disclosed in U.S. Pat. No. 2,532,145, entitled "PUMP," to Byram; U.S. Pat. No. 2,545,626, entitled "SPIRAL GEAR PUMP AND ALLIED DEVICE," to Moineau; and U.S. Pat. No. 4,325,682, entitled "APPARATUS FOR DISCHARGING MATERIALS," to Willis.

Prior art using these three approaches in all cases, except the last reference to Willis, requires that the moving joints, flexing connections, bearings and rotating seals be located within the pumping chambers, and again, these components must come in contact with the material being pumped. The invention by Willis teaches that only one flexing connection is in contact with the pumpable material, but Willis also requires a flexible process hose and extensive disassembly to replace the outer gear.

It is well known in the practice of this prior art that extended operating time before failure of components other than the helical pair is achieved by avoiding contact of the pumpable material with the moving joints, flexing connections and bearings. The prior art presents two arrangements whereby the pumpable material does not contact with these moving parts. First, the mechanical parts to be protected are sealed from contacting the pumpable material with a device that does not restrict the movement of the component being protected; and secondly, the mechanical part to be protected is located on the exterior of chambers containing the pumpable material. Examples of sealing means invented to protect moving mechanical parts from contact with the pumpable material are U.S. Pat. No. 4,639,200, entitled "SEALING APPARATUS FOR A GEAR BALL JOINT," to Baumbardner et al.; U.S. Pat. No. 2,915,979, entitled "GRIT AND CORROSION SEAL FOR UNIVERSAL JOINTS IN PUMPS HAVING ECCENTRICALLY MOVING ROTORS," to Bourke et al.; and U.S. Pat. No. 3,165,065, entitled "FLEXIBLE COUPLING FOR SCREW PUMP ROTORS," to Stickel. Such seals are effective in increasing pump operating time before component failure, but extensive disassembly is still necessary to replace the protected component when it does fail. The use of such seals, moreover, is not safe for use with pumpable explosive mixtures because of the potential explosion when the sealing component fails. Inspection of the seals to insure their integrity prior to failure is also costly and time consuming because of the elaborate disassembly required to view the seals and inspect or replace them. The second method to prevent contact between the pumpable material and certain moving parts involves locating flexible joints to the exterior of chambers containing the pumpable material, as taught by Willis in his previously mentioned U.S. Pat. No. 4,325,682; and U.S. Pat. No. 3,930,765, entitled "ROTARY DISPLACEMENT PUMPS," to Waite. These methods avoid contact of the pumpable material with the components located external of the pumping chambers and also provides for inspection and maintenance of these components without pump disassembly. Nonetheless, at least one flexing or rotating seal does come in contact with the pumpable material. Replacement of the helical gear pair, moreover, requires extensive disassembly and disconnection from processing equipment or piping.

Hollow inner gears as well as closed end outer gears are known in the prior art. For example U.S. Pat. No. 2,525,265 to Moineau and U.S. Pat. No. 3,746,310, entitled "VIBRATOR DRIVEN BY PRESSURIZED FLUID" to Fransson et al. Moineau '265 discloses the use of multiple gear pairs to construct a glandless pump. Embodiment of the disclosure requires a complexity of bearings for rotating and sliding components as well as rotating inner gears. Disassembly and repair is made more complex by the required arrangement and many catch points for contamination are created. Fransson et al. '310 teaches a rotating and orbiting inner gear, but the device has no provision for attachment of a mechanical drive. Another hollow inner gear for fluid flow known to the prior art is disclosed in U.S. Pat. No. 4,614,232, entitled "DEVICE FOR DELIVERING FLOWABLE MATERIAL" to Jurgens et al. In this disclosure fluid flow through a hollow stationary inner gear creates rotation and orbiting of an outer gear. The outer gear also serves as the inner gear of a second Moineau gear pair. A rotating seal is required to close one end of the rotating and orbiting gear and there is no provision for connection of a rotary drive.

The prior art does not reveal the novel combination of a closed end outer gear rotatably driven about a nonrotatable hollow inner gear adapted for fluid flow through the inner gear. The present invention represents a new and useful improvement in Moineau gear pairs and it makes possible realization of the objectives of the invention.

SUMMARY OF INVENTION

This invention is an improved Moineau pump in which a closed end outer gear rotates about a nonrotatable hollow inner gear adapted for fluid flow through the inner gear. It is an object of the present invention to provide an improved Moineau pump that in one embodiment allows all seals and flexing components to be located so they do not contact the pumpable material in normal pump operation.

It is a further object of the present invention to provide an improved Moineau pump that facilitates disassembly of the pump for purposes of inspection or replacement of either or both the helical gear pair and all drive components without removal of the pump body from equipment or piping to which it is connected.

A still further objective is to provide an improved means of securing the inner gear of the helical gear pair from both rotational and axial movement while permitting it to wobble or orbit as the outer gear is rotated about its own axis.

According to this invention of an improved Moineau type pump, an outer gear closed on one end and adapted for connection to a rotational drive means is positioned rotatively about and orbital relative to a nonrotatable hollow inner gear adapted for pumpable material flow through said inner gear. Suitable orbital bearing assemblies, flexible drive components, resilient mountings, or resiliently mounted rotating seals are adapted according to particular embodiments of the invention. In one embodiment the inner gear is fixed vertically in a hopper containing the pumpable material with the bottom end secured to and passing through the bottom of the hopper. The outer gear is rotatably positioned over the inner gear with the closed end oriented up and connected to a drive means which imparts rotation and permits the outer gear to orbit while rotating. The drive means and connecting drive shaft are located above and out of contact with the pumpable material and no rotating or flexing seals are required. The pump in this embodiment and others are made clear by the drawings and description.

DESCRIPTION OF THE PREFERRED EMBODIMENT

Figure 1:
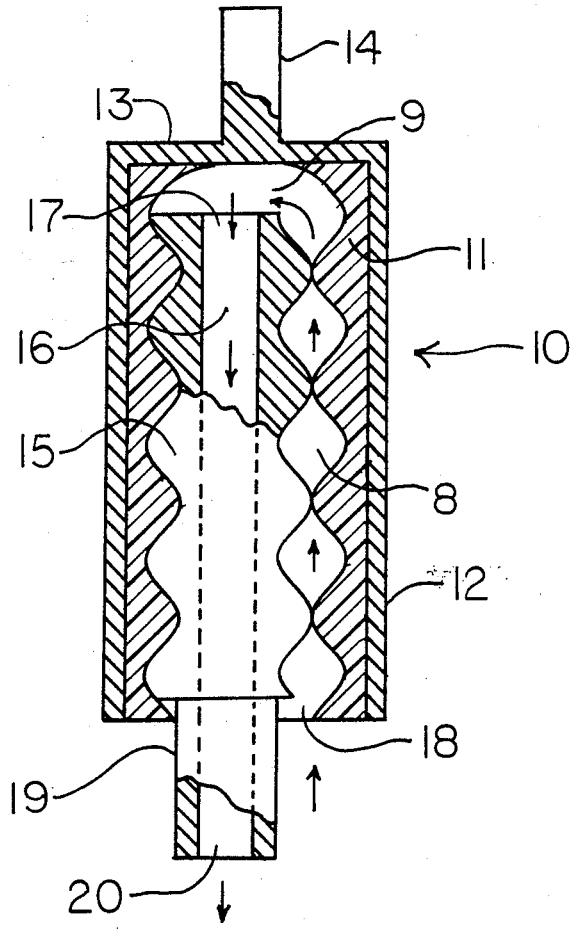
FIG. 1 is a partial cross-sectional view of the Moineau gear pair assembly according to the invention.

The pump, shown in FIG. 1, comprises a Moineau gear pair assembly 10 in which the outer gear 11 is contained in a rigid housing 12 with a closed end 13. The closed end 13 is provided with a rotary drive connection means 14 for rotational drive connection. The inner gear 15 is rigidly attached to a connecting member 19 and has an internal chamber 16 extending through the length of the inner gear 15 and its connecting member 19. A path for flowable material is provided from the open end 18 of the outer gear 11 through the progressing cavities 8 of the gear pairs 11 and 15 to the closed end cavity 9 and through the opening 17 to the chamber 16 within the inner gear 15 and through the chamber 16 to port 20.

The operation of the improved Moineau gear pump as embodied herein is described as follows. Rotational motion provided by an external means mounted on the rotational drive connection means 14 is imparted to the outer gear 11 of the Moineau gear pair assembly 10. As the outer gear 11 is rotated about the inner gear 15 and the inner gear internal chamber 16, pumpable material is drawn into open end 18 and becomes contained within a progressing cavity 8. The material is moved within the progressing cavity 8 axially towards the outer gear closed end 13. When a progressing cavity 8 discharges material into the closed end cavity 9, the material already contained within the closed end cavity 9 is forced through the opening 17 of the internal chamber 16 of the inner gear 15 and then axially through the internal chamber 16 of the inner gear connecting member 19 and port 20. The flow direction of the pumpable material can be reversed by reversing the rotational motion imparted to the outer gear 11 by the rotational drive connection means 14.

In the preferred embodiment of the invention, the rigid housing 12 and the closed end 13 are manufactured integrally as one unit and the outer gear 11 is cast with a smoothly contoured end chamber 9. The integration of the closed end 13 and the rigid housing 12 with a smoothly contoured end of outer gear 11 allows for a better flow pattern of the pumpable material, which can be quite viscous depending upon the application of the invention. More importantly, however, and if the invention as described herein is used in applications wherein contamination is a consideration, the integral construction of the rigid housing 12 and the closed outer end 13 eliminates small crevices and cracks where either residual material may reside or where bacterial growth may occur. If contamination is not of concern, however, the rigid housing 12 and the closed end 13 may be separate units and may be connected together by any attachment known to the art for connecting outer gears to pump bodies and process piping. This construction has the advantage of permitting use of currently commercial available outer gears without modification.

Figure 2:
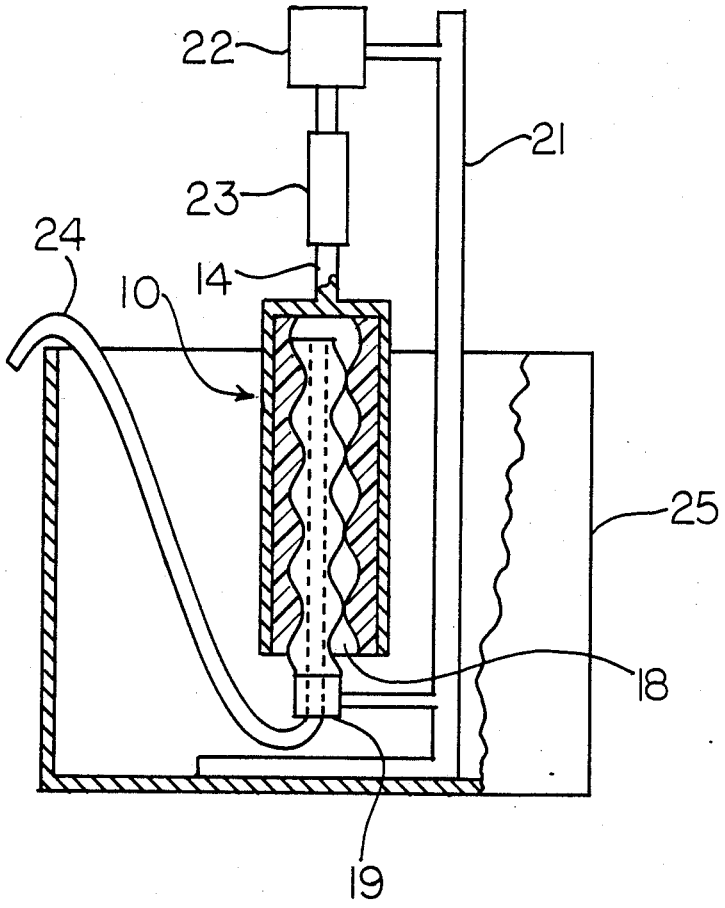
FIG. 2 is a schematic view of an embodiment of this invention for moving pumpable material into or out of a non-attached pumpable material containment vessel.

The embodiment shown in FIG. 2 illustrates use of the improved Moineau gear pair assembly 10 with a rigid frame 21. The rigid frame 21 provides a nonrotatable connection for the inner gear connecting member 19 and provides support for an outer gear rotary drive means 22. The rotary drive means 22 is connected to the flexible rotary drive coupling 23 which is in turn connected to the rotary drive connection means 14 of the outer gear 11. Any one of several flexible rotary drive couplings, common in the art, that transmit rotary driving force while permitting the outer gear to orbit while rotating may be used. A drive shaft with one universal joint at each end is one commonly used flexible rotary drive coupling. A flowable material conduit 24 in the form of a hose or pipe is connected to the inner gear connecting member 19 to provide a conduit for flowable material to the exterior of the flowable material containment vessel 25. The open end 18 of the Moineau gear pair assembly 10 is open to the containment vessel 25. This arrangement allows for filling or discharging pumpable material from the containment vessel without rotating seals. Flexible drive components that would come in contact with the pumpable material are not required so long as the height of the pumpable material in the containment vessel 25 is maintained below the height of the rotary drive connection means 14.

Figure 3:
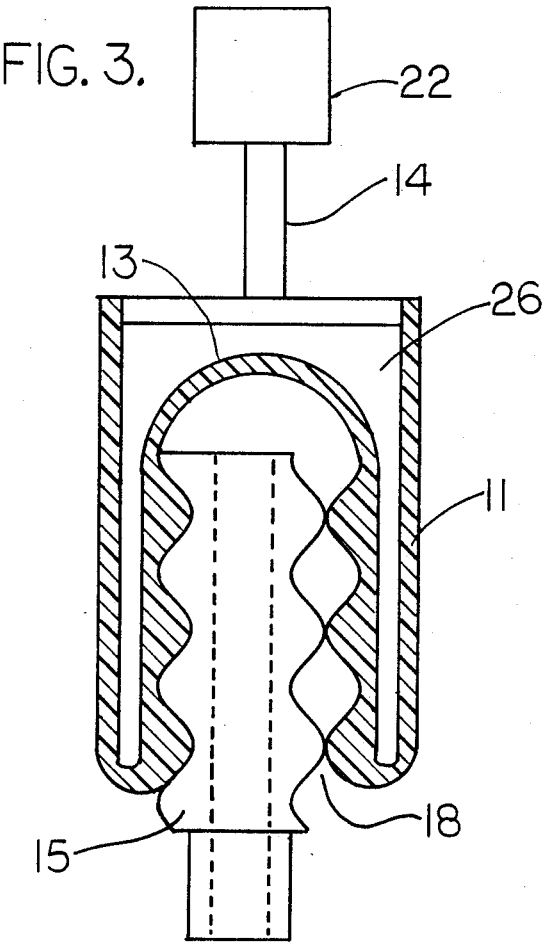
FIG. 3 is a schematic view of an embodiment of this invention using a flexible closed end outer gear.

FIG. 3 illustrates one embodiment of the invention in which a flexible rotary drive coupling connection is not required. In this embodiment the outer gear 11 is manufactured from a resilient material and is similar in shape to conventional wobble stators except that it includes a closed end 13. The resilient material allows the outer gear 11 to flex as it orbits about the stationary inner gear 15. Because wobble motion of the outer gear 11 is required, the rigid housing 12 shown in FIGS. 1 and 2 is omitted. The outer gear 11 is fitted with a rotary drive connection means 14 for connection to the rotary drive means 22. The shape of the molded outer gear 11 cooperates with the rotary drive connection means 14 to create a sealed cavity 26 with in the molded outer gear 11.

Any substance, including the pumpable material, may be contained within the sealed cavity 26 to provide pressure within the cavity proportional to the outlet pressure of the pump. This pressure is advantageous in maintaining contact between the inner gear 15 and outer gear 11. While the pressure is typically provided in prior art by the pumpable material, use of a secondary fluid is permitted by the closed end construction of the outer gear 11. The problem of contamination of the pumpable material with previously pumped material has thus been nullified by this construction of the outer gear 11. Possible catch points within the cavity in which solids can settle and thereby cause damage to the flexing elastomeric outer gear 11 are also eliminated by the novel incorporation of the secondary sealed cavity 26.

Figure 3A:
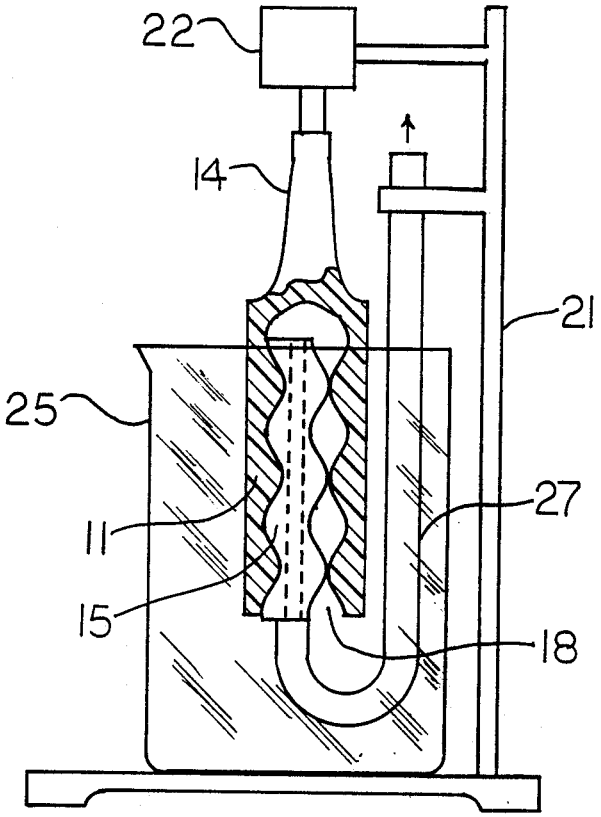
FIG. 3A is a schematic view showing alternate construction of the flexible outer gear.

FIG. 3A illustrates an alternate construction of the elastomeric outer gear 11 useful in small pump applications such as chemical laboratory research. In the embodiment, the elastomeric outer gear 11 is extended, having an essentially circular cross-section and a slightly smaller diameter than the outer gear 11. The extension serves as a flexible rotary drive connection means 14 connected to a rotary drive means 22. The hollow inner gear 15 has a rigid tubular extension 27 replacing the inner gear connecting member shown in the previous embodiments. The tubular extension 27 may be constructed from glass or metal tubing commonly found in chemical research laboratories, or it may be constructed from some other suitably rigid material. The pump of this particular embodiment may be constructed such that the inner gear 15 and the tubular extension 27 are integrally connected and may be fabricated as a single unit, while the extended outer gear 11 and the rotary drive connection means 14 may be integrally connected and formed out of a suitable resilient material, such as rubber. The rigid tubular extension 27 is attached to a rigid frame member 21 which also serves as a rigid connection for the drive means 22 and support for the material containment vessel 25.

As embodied herein, the open end 18 of the outer gear 11 is immersed in a containment vessel 25 filled with the pumpable material. Rotary drive means 22 transfers rotary motion through the rotary drive connection means 14 to the outer gear 11 to which it is preferably integrally connected and made from a resilient material. As outer gear 11 rotates and wobbles, pumpable material is drawn into a progressing cavity 8 and is axially moved towards the closed end 13 of the outer gear 11 and into the opening 17 and through the internal chamber 16 of the inner gear 15. The pumpable material is then pumped through a rigid tubular extension 27.

It is obvious to those experienced in the art that the use of the pump invented herein with its simplicity of design and construction provide cost and time reductions in assembly, disassembly, cleaning and maintenance of laboratory and other small pumps. Such a pump as described herein provides an attractive replacement for peristaltic pumps used for research laboratory applications.

Figure 4:
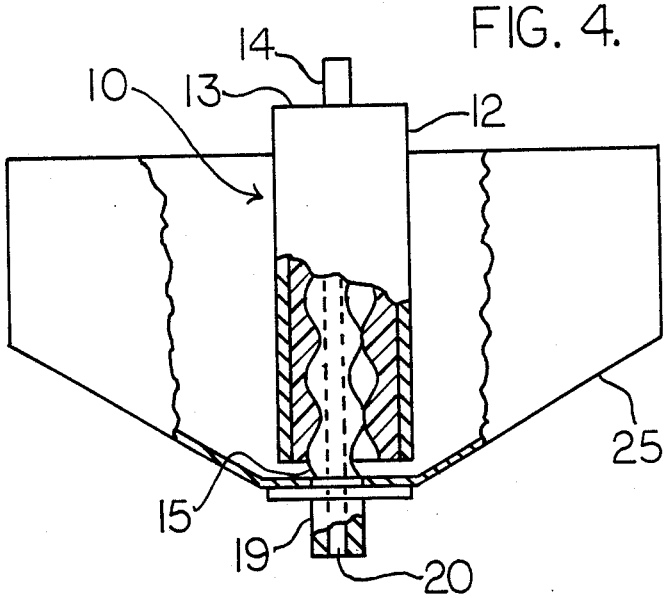
FIG. 4 is a schematic in partial sections showing an embodiment of the invention with a closed end outer gear rotatable and orbitable about a nonrotatable inner gear attached to a fluid containment vessel.

FIG. 4 illustrates the pump of this invention embodied for use with a material containment vessel 25 such as a hopper which also functions as a nonrotatable rigid securement means for the hollow inner gear 15. The Moineau gear pair assembly 10 is located within the containment vessel 25 and the inner gear connecting member 19 is connected to and passes through the bottom of the containment vessel 25 with no rotatable or flexible connection means. The closed end 13 of the outer gear rigid housing 12 extends above the height of the containment vessel 25. The rotary drive connection means 14 and connected drive components are also located above and out of contact with the pumpable material contained within the containment vessel 25. In this arrangement, material flow to or from the pump port 20 requires only one moving part in contact with the pumpable material and provides easy access to the outer gear for inspection or replacement without disconnecting processing pipes or hoses connected to the pump. This assembly offers advantages which will become apparent to those familiar with the food processing industry and explosives industry because of the cleanliness, the lack of contamination catch points, and the lack of pinch points and rotating seals. Individuals familiar with the cementitious construction industry will appreciate the several advantages that this embodiment offers in that the outer gear 11 can be replaced easily under construction site working conditions. The absence of pivoting and flexing connections in contact with the abrasive pumpable cementitious mixtures, moreover, puts an end to extensive maintenance requirements.

Figure 5:
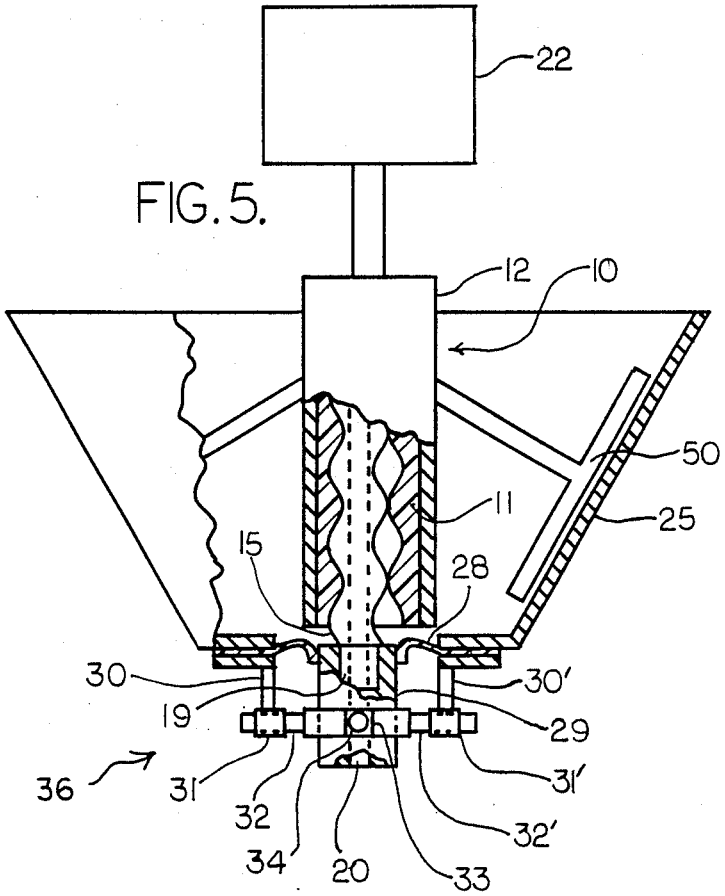
FIG. 5 is a schematic in partial section showing an embodiment of the invention with a closed end outer gear attached to a fluid containment vessel using a radial rod and bearing nonrotational assembly and a flexible diaphragm.

FIG. 5 is an embodiment of the present invention in which the unique Moineau gear pair assembly 10 is essentially contained within a pumpable material containment vessel 25. In this configuration, the outer gear 11 does not wobble. Therefore, to accommodate the relative motion of the inner gear 15, an orbital assembly 36 has been incorporated. The inner gear connecting member 19 is connected to a coupling device 29 which extends the internal chamber 16 of the hollow inner gear 15 to port 20. The coupling device 29 is nonrotatably but orbitally attached to the containment vessel 25. A flexible diaphragm 28 creates a nonrotating seal between the containment vessel 25 and the orbital coupling device 29. The flexible diaphragm 28 further allows for orbital movement of the inner gear 15 relative to the closed end outer gear 11. The outer gear 11 is fixedly attached to the rotary drive means 22 by means of the rigid housing 12. An orbital assembly 36 is located below the containment vessel 25, out of contact with the pumpable material.

Figure 5A:
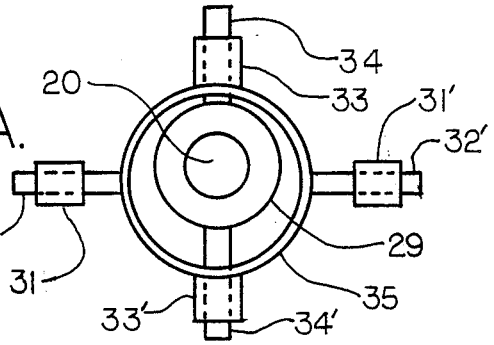
FIG. 5A is a plane view of an improved orbital assembly utilized in FIG. 5.

The orbital assembly 36, shown in elevation in FIG. 5 and in plane in FIG. 5A, comprises two rigid coupling device extension members 34 and 34' fixedly attached to the coupling device 29 and extending radially therefrom in opposite directions through linear bearings 33 and 33'; linear bearings 33 and 33' are fixed to a rigid load transfer ring 35 fixedly attached to rigid load transfer ring extension members 32 and 32' located ninety degrees with respect to the coupling device extension members 34 and 34'; load transfer ring extension members 32 and 32' extend through linear bearings 31 and 31' attached to the containment vessel 25 through containment vessel connecting members 30 and 30'. Although the embodiment of the orbital assembly 36, shown in FIGS. 5 and 5A, has two coupling device extension members 34 and 34' and two load transfer ring extension members 32 and 32', only one rigid coupling device extension member 34 extending through one linear bearing 33 and only one ring extension member 32 extending at an angle of ninety degrees from the axis of the coupling device extension member 34 through a second linear bearing 31 is necessary for rotary and axial restraint without orbital restraint of the inner gear 15. The arrangement of the orbital assembly 36 wherein two coupling device extension members 34 and 34' and two load transfer ring extension members 32 and 32' and the appropriate linear bearings 31, 31', 33, and 33' are used to provide additional strength to the orbital assembly 36. Thus, this unique, heretofore unrealized, orbital assembly 36 permits orbital attachment and motion of the inner gear 15, but restrains its radial and axial motion while permitting rotation of the outer gear 11 about its own axis. This improved orbital assembly 36 restrains the inner gear 15 from rotary and axial movement with greater reliability and structural integrity than known in prior art. This arrangement is also useful for orbital attachment with rotational and axial restraint of the outer gear 11 while permitting rotation of the inner gear 15 about its own axis when the load transfer ring 35 has a circumference large enough to surround the outer gear 11 and appropriate rigid connection means are employed.

When the embodiment shown in FIG. 5 is used to pump material such as cementitious construction mixes with separation or setting characteristics that make it desirable to maintain agitation of the mix, the flexing of the flexible diaphragm 28 provides beneficial agitation. Additional agitation may be provided by blades 50 attached to and extending from the outer gear housing 12.

Figure 6:
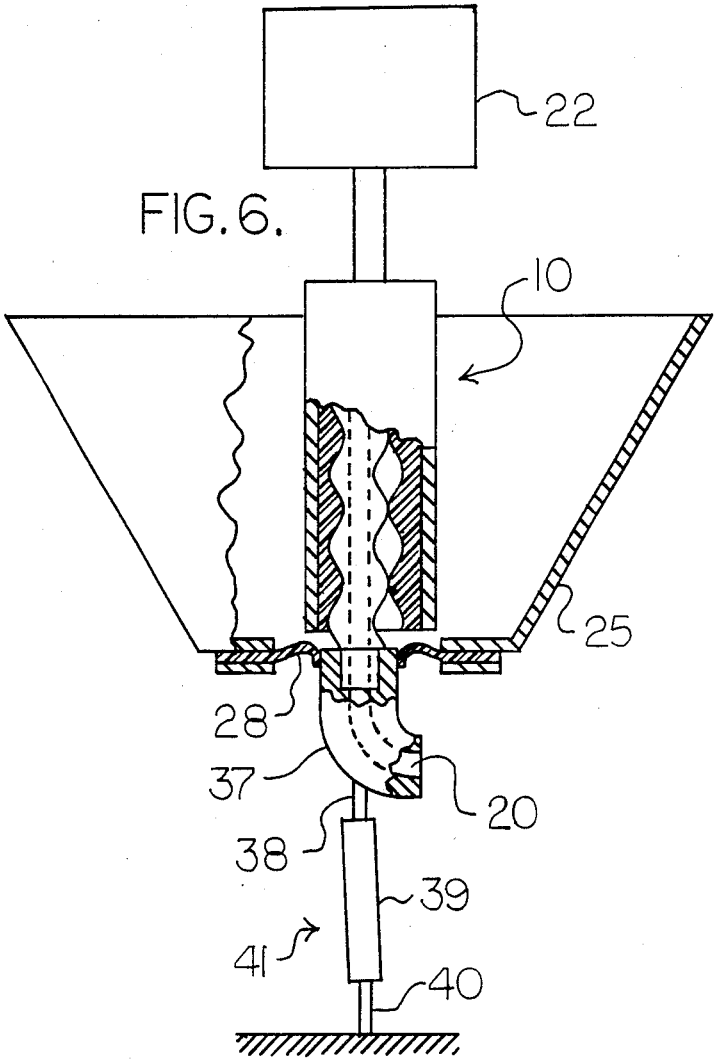
FIG. 6 is a schematic in partial section showing an alternate nonrotational assembly consisting of a nonrotatable flexible rotary coupling assembly.

FIG. 6 is an illustration of an embodiment similar to that illustrated in FIG. 5 wherein an alternate coupling device 37 replaces coupling device 29, and wherein an alternate orbital assembly consisting of a nonrotatable flexible rotary coupling assembly 41 replaces orbital assembly 36. Coupling device 37 receives the inner gear connecting member 19 and provides a conduit to port 20. Orbital connecting means 38 connects the coupling device 37 to a flexible rotary coupling 39 which is in turn connected to a fixed connection means 40. The nonrotating flexible rotary coupling 39 may be any of several common in the art, for use in conjunction with a rotary drive means to permit the rotatable gear of the Moineau gear pair assembly 10 to also wobble or orbit. In this embodiment, rotary drive means 22 imparts rotary motion to the outer gear 11. Inner gear 15 is allowed to wobble and orbit about the rotation axis, but alternate coupling device 37 prevents rotational or axial motion of the inner gear 15. Thus, greater stability and reliability are provided for in this and other embodiments.

Figure 7:
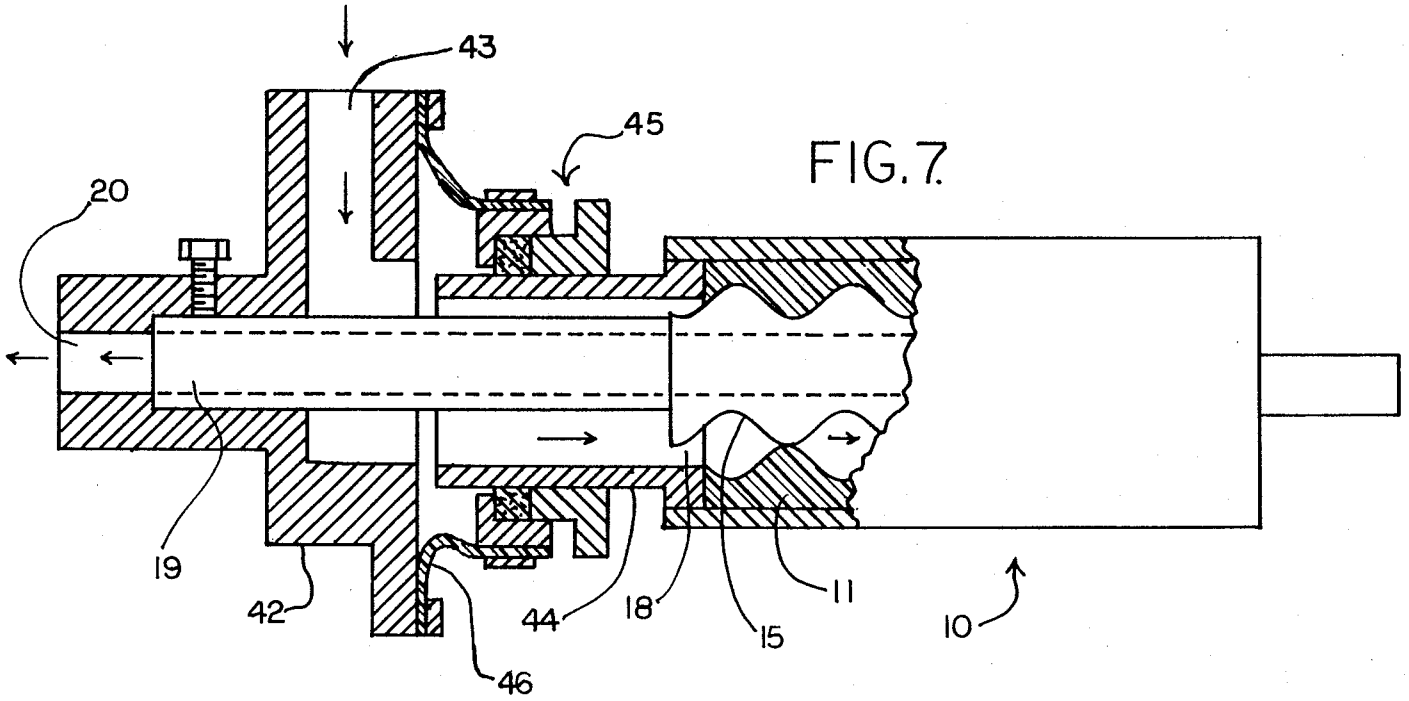
FIG. 7 is a schematic in partial section showing an embodiment of the invention with a closed outer gear mounted rotatably and orbitably relative to a hollow inner gear mounted fixedly to a pump body.

FIG. 7 is an embodiment of the present invention in which the Moineau gear pair assembly 10 is connected to a pump body 42 having inlet port 43 and outlet port 20. The hollow inner gear 15 is nonrotatably connected to the pump body 42 through the connecting member 19. The closed end outer gear 11 is rotatably and orbitally connected through the outer gear extension 44, rotating seal assembly shown generally at 45 and flexible coupling member 46. The general illustration of FIG. 7 illustrates a simplified means to assemble the present invention to a pump body 42 that will allow for disassembly and inspection or replacement of the Moineau gear pair 10 without disconnecting the pump body 42 from process piping or other items attached to the pump parts.

Figure 8:
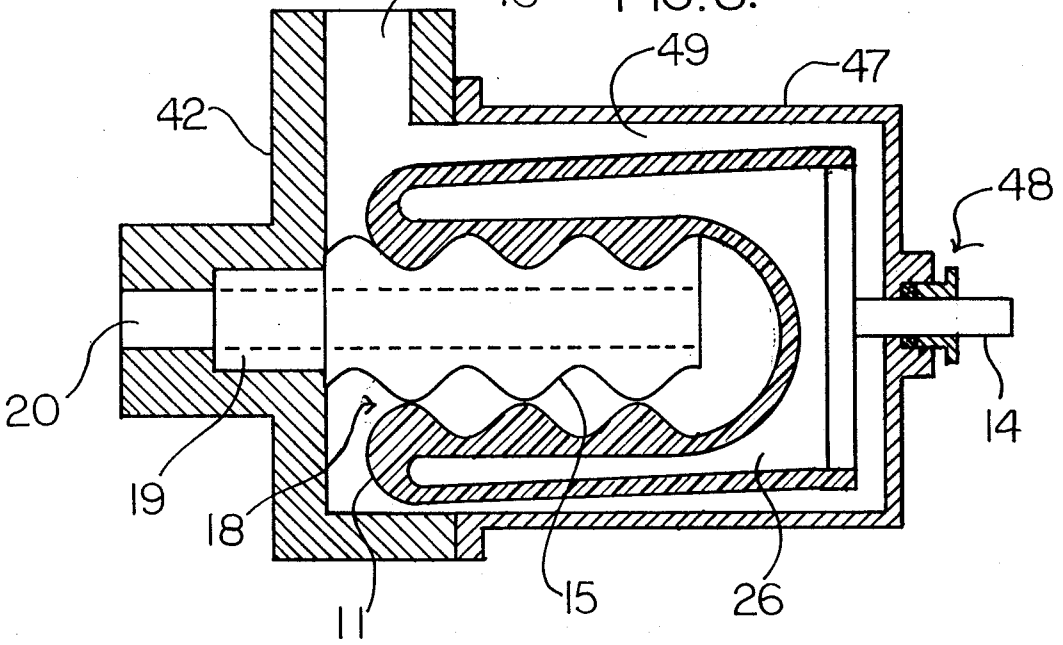
FIG. 8 is a schematic showing embodiment of the present invention utilizing a flexible closed end outer gear contained within the cavity of a pump body operative with the hollow inner gear.

FIG. 8 illustrates an embodiment using the closed end outer gear 11 and hollow inner gear 15 of the present invention in assembly with a pump body 42 wherein the outer gear 11 is molded as described in FIG. 3. This embodiment differs from FIG. 3, however, in that the Moineau gear pair assembly 10 is located in a pump chamber 49 created by the pump housing 47 and the pump body 42 to which the housing 47 is connected. A rotary seal 48 allows for extension of rotary drive connection means 14 to the outside of chamber 49. The inner gear 15 is connected nonrotatably to the pump body 42. Chamber 49 is thus extended from the port 20 through the hollow inner gear 15. The open end 18 of the outer gear 11 communicates through the pump body chamber 49 to port 43. It is apparent from the description of this embodiment that disassembly and inspection or replacement of either or both gears of the gear pair may be accomplished without disconnection of the pump body 42 from the piping or other items connected to the pump.

Figure 9:
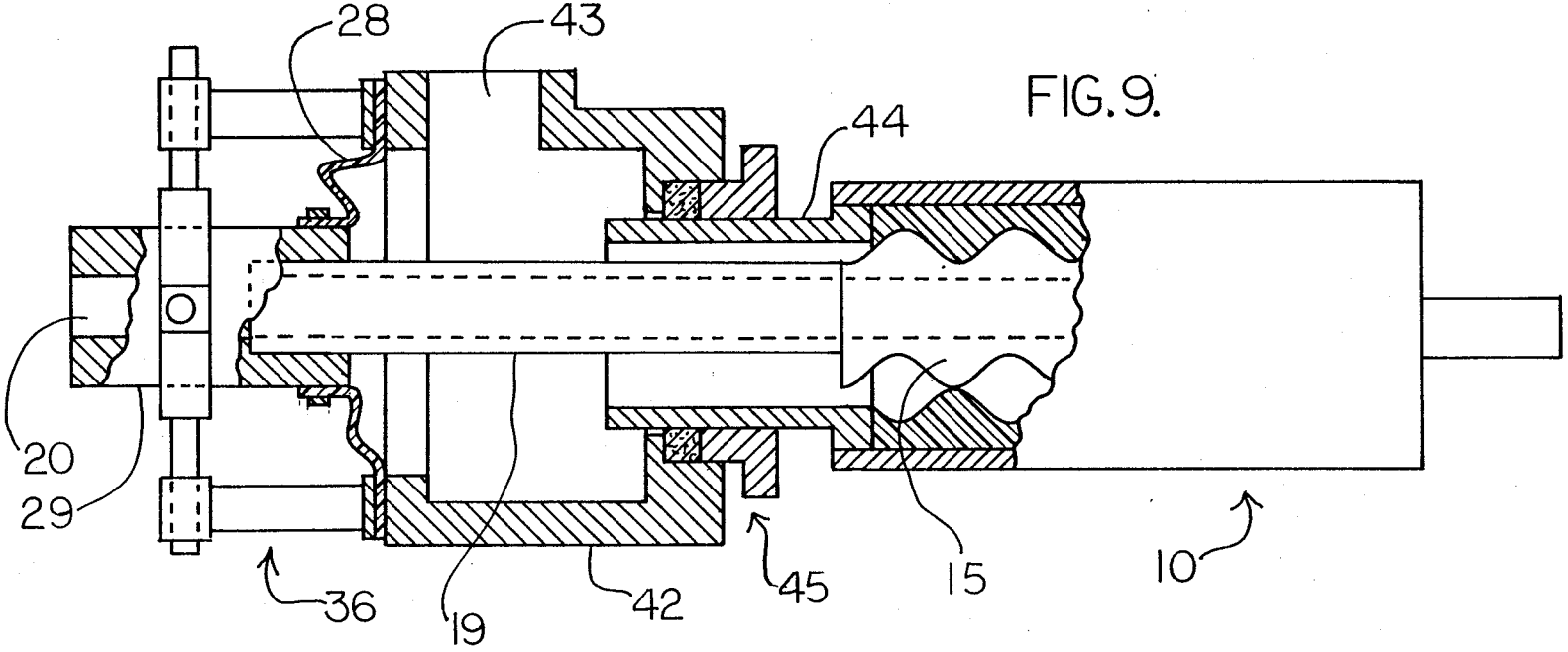
FIG. 9 is a schematic in partial section showing an embodiment of the invention with a closed end outer gear mounted rotatably about a fixed axis and a nonrotatable orbital inner gear attached to a pump body.

FIG. 9 is yet another pumping apparatus embodying the Moineau closed end outer gear 11 and hollow nonrotatable inner gear 15 of this invention. The Moineau gear pair assembly 10 is attached to a pump body 42. The outer gear extension 44 is rotatably connected to the pump body 42 by passing through a rotating seal 45. The hollow inner gear 15 is connected through connecting member 19 to coupling device 29. The coupling device 29 is nonrotatably but orbitally attached to the pump body 42 through the orbital assembly 36 which is constructed as described in FIG. 5 and FIG. 5A. In this embodiment the flexible diaphragm 28 sealingly connects the coupling device 29 to the pump body 42. The coupling device 29 also extends the interior chamber of the hollow gear 16 to port 20 which is a connection means to process hose or flexible pipe coupling. The objectives of this invention are achieved in this embodiment in that the gear pair may be removed, inspected and replaced without disturbance of the process piping. Orbiting mechanical components are located out of contact with the pumpable material, and the improved orbital arrangement for the inner gear provides greater rotational and axial restraint than devices of the prior art.

It will be clear that numerous modifications may be made to the embodiments described herein without departing from the spirit of the invention, and I therefore do not intend to limit myself in any way whatsoever except as set forth in the claims which follow.

I claim:

1. In a progressing cavity positive displacement rotary pump wherein two helical gears, one inside the other, are engaged with each other along a sealing line to create cavities which progress axially as one of the gears is rotated relative to the other, wherein the improvement comprises:

a. an outer gear having a closed end and an open end; and b. a hollow inner gear wherein said outer gear is rotatable about and orbital relative to said hollow inner gear which is nonrotatable, and wherein a pumpable material within said cavities progresses axially from said open end of said outer gear to said closed end of said outer gear and is further pumped into and through said hollow inner gear.

2. A pump, as recited in claim 1, wherein said outer gear and said closed end of said outer gear are integral.

3. A pump, as recited in claim 1, wherein said outer gear and said closed end of said outer gear are composed of an elastomeric material.

4. A pump, as defined in claim 1, wherein the closed end of the outer gear defines a closed end cavity adjacent the anterior end of the hollow inner gear, the pumpable material progressing from the first-mentioned cavities into the closed end cavity and then into and through the hollow inner gear.

5. A pump, as recited in claim 1, wherein said outer gear and said closed end of said outer gear are integrally constructed from an elastomeric material.

6. A pump, as recited in claim 1, wherein said outer gear and said closed end of said outer gear are integrally constructed from an elastomeric material and specially formed to create a cavity wherein said cavity is closed by a rotary drive connection means and wherein said cavity is sealed from contact with said pumpable material.

7. A pump, as recited in claim 6, wherein said pump is situated within a chamber of a vessel; and wherein said rotary drive connection means extends beyond and is sealed from said chamber by a rotary seal; and wherein said inner gear is connected nonrotatably to said vessel and extends said chamber through an outlet port of said vessel.

8. A pump, as recited in claim 1, wherein said hollow inner gear is attached to and forms an outlet through a material containment vessel; and wherein said open end of said outer gear is located within said material containment vessel.

9. A pump, as recited in claim 1, wherein said hollow inner gear is orbitally connected through a flexible diaphragm and a means for restraining axial and rotational motion of said inner gear to a material containment vessel; and wherein said hollow inner gear forms an outlet from said material containment vessel; and wherein said open end of said outer gear is situated within said containment vessel.

10. A pump, as recited in claim 1, wherein said hollow inner gear is orbitally connected through a flexible diaphragm and a means for restraining axial and rotational motion of said inner gear to a pump body and forms an outlet from said pump body; and wherein said open end of said outer gear is attached to said pump body through a rotating seal.

11. In a progressing cavity positive displacement rotary pump wherein two helical gears, one inside the other, are engaged with each other along a sealing line to create cavities which progress axially as one of the gears is rotated relative to the other, an improvement comprising an outer gear having a closed end and an open end, which is rotatable about and orbital to a hollow nonrotatable inner gear wherein a pumpable material within said cavities progresses axially from said open end to said closed end of said outer gear and is further pumped into and through said hollow inner gear; and further comprising a rotary drive means connected to a flexible rotary drive coupling attached to said closed end of said outer gear; an inner gear connecting member connecting a flowable material conduit to said inner gear; and a frame rigidly attached to said rotary drive means and said inner gear connecting member at opposite ends thereof; and wherein said closed end of said outer gear, said rotary drive connection means, said rotary drive means, said flexible rotary drive coupling, and that portion of said frame rigidly attached to said rotary drive means are positioned above the surface of said pumpable material contained within a containment vessel; and wherein as said rotary drive means rotates said outer gear said pumpable material is pumped from said open end of said outer gear through said inner gear and out of said containment vessel through said flowable material conduit.

* * * * *